US005284035A

United States Patent [19]

Pabst et al.

[11] Patent Number: 5,284,035

[45] Date of Patent: Feb. 8, 1994

[54] APPARATUS FOR MONITORING THE APPLICATION OF DYE TO TEXTILE MATERIAL

[75] Inventors: Manfred Pabst, Cologne; Kurt van Wersch, Wegberg, both of Fed. Rep. of Germany

[73] Assignee: A. Monforts GmbH & Co., Moenchengladbach, Fed. Rep. of Germany

[21] Appl. No.: 988,451

[22] Filed: Dec. 10, 1992

[30] Foreign Application Priority Data

Dec. 10, 1991 [DE] Fed. Rep. of Germany ..... 4140600

[51] Int. Cl.[5] ..... D06B 23/26

[52] U.S. Cl. ..... 68/13 R; 68/19.1; 68/22 R; 118/665; 118/672

[58] Field of Search ..... 8/151, 158; 68/13 R, 68/19.1, 22 R; 118/665, 672

[56] References Cited

U.S. PATENT DOCUMENTS

| | | | |
|---|---|---|---|
| 4,087,568 | 5/1978 | Fay et al. | 118/672 X |
| 4,893,485 | 1/1990 | Schwemmer et al. | 118/665 X |
| 5,050,258 | 9/1991 | Fisher et al. | 8/151 |

FOREIGN PATENT DOCUMENTS

3925444A1 2/1991 Fed. Rep. of Germany .

*Primary Examiner*—Philip R. Coe

*Attorney, Agent, or Firm*—Shefte, Pinckney & Sawyer

[57] ABSTRACT

The present invention provides a method and apparatus for monitoring the application of dye to a traveling web of textile material. The apparatus includes a color characteristic detecting assembly which is movable between an initial detecting position in which it detects a color characteristic of the textile material web shortly after the web has emerged from a dye liquor bath and a post-drying detecting position in which it detects a color characteristic of the textile material web after the web has been handled in a drying device. The post-drying detection of the textile material web enables the apparatus to detect an out-of-limits color characteristic situation which may not appear or be detectable until after the web has been subjected to the drying process. The color characteristic detecting assembly is connected to a control unit which controls the nip pressure of a pair of nip rollers which remove excess moisture from the textile material web.

5 Claims, 1 Drawing Sheet

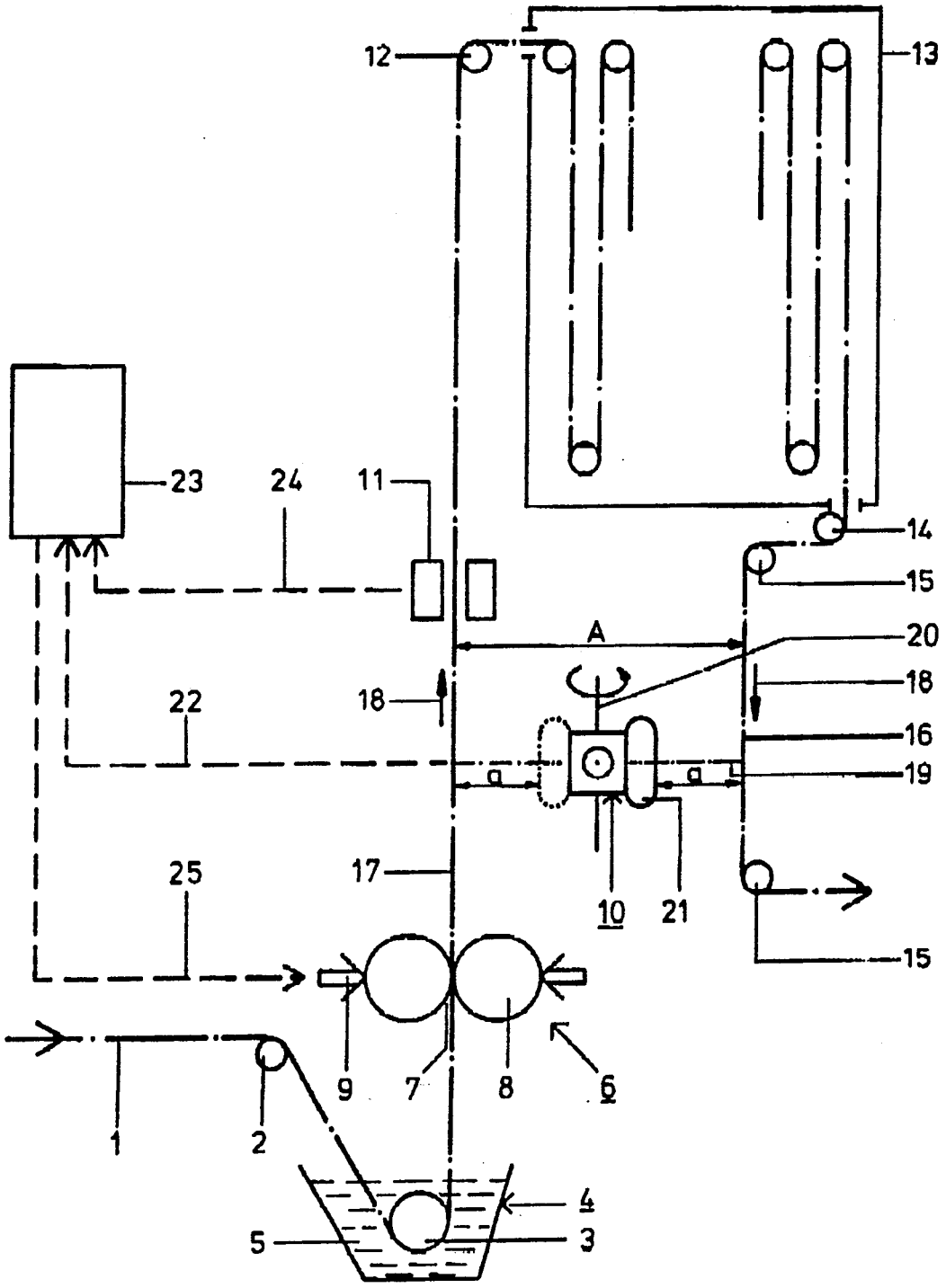
12
13
23
24
11
14
15
A
20
18
22
18
16
19
a
a
25
17
10
21
15
9
7
8
6
1
2
4
5
3

APPARATUS FOR MONITORING THE APPLICATION OF DYE TO TEXTILE MATERIAL

BACKGROUND OF THE INVENTION

The present invention relates to a method and apparatus for monitoring the application of dye to textile material and, more particularly, to a method and apparatus for monitoring the application of dye to a traveling web of textile material.

It is known to detect a color characteristic of a web of textile material very shortly after the web has been subjected to a dye application process in which dye has been applied to the web to impart the desired coloring thereto. For example, German Patent Document DE-OS 39 25 444 discloses an apparatus which detects a color characteristic of a traveling web of textile material immediately after the web has emerged from a dye liquor bath in which dye has been applied to the web. The detecting arrangement disclosed in this document directly measures a color characteristic of the traveling web of textile material as opposed to indirectly measuring a color characteristic by, for example, measuring the moisture content of the web and extrapolating information from such a measurement regarding the color characteristic of the web. As the detecting of the color characteristic of the web is typically performed at a location along the web travel path only a few meters beyond the dye application location, this known detecting arrangement provides relatively rapid feedback concerning the color characteristic of the web. Accordingly, if it is detected that the color characteristic of the web is not within acceptable limits, immediate corrections, including shutdown of the travel of the web, can be implemented to prevent the following portions of the web from also being handled such that they, too, are imparted with an improper color characteristic.

While the known detecting arrangement discussed above readily lends itself to incorporation into an automatic control system which automatically controls the travel of the web, as well as other parameters of the web handling process such as, for example, the removal of excess moisture from the web, such a detecting arrangement is not capable of detecting an out-of-limits color characteristic situation which is only detectable after the web has already traveled past the detecting position at which the detecting arrangement operates. For example, an out-of-limits color characteristic of the web may not be detectable until after the web has been handled in a drying process which takes place further downstream from the detecting location. Accordingly, the need exists for a method and apparatus which provides the capability to monitor the application of dye to a traveling web of textile material in such a manner that an out-of-limits color characteristic situation of the web can be detected and automatically taken into account in handling the web.

SUMMARY OF THE INVENTION

Briefly described, the present invention provides, in one aspect thereof, a method for controlling a dye treatment process in which dye is applied to a web of textile material which includes traveling the web through a dye liquor bath from which the web emerges in a dye treated condition and squeezing the dye treated web to effect removal of excess dye therefrom. Additionally, the method includes monitoring a color characteristic of the dye treated web after said squeezing and controlling said squeezing in response to said monitoring, traveling the web further through another treatment device after said monitoring, additionally monitoring a color characteristic of the web after the web has exited said another treatment device, and additionally controlling the dye treatment process in response to said additionally monitoring.

Preferably, the step of further traveling the web includes traveling the web through a drying device. Also, the step of controlling the dye treatment process in response to said additionally monitoring a color characteristic of the web preferably includes selectively adjusting the parameters of the color distribution characteristic of the web.

According to another aspect of the present invention, there is provided an apparatus for controlling a dye treatment process in which a web of textile material is sequentially traveled through a dye application location at which dye is applied to the web, a moisture reduction location at which dye is removed from the web by a device for selectively removing moisture, and a drying location at which the dye treated web is subjected to a further treatment. The apparatus includes means for detecting a color characteristic of the web and controlling means. The color characteristic detecting means is operable in an initial detecting position in which it detects a color characteristic of the web as the web travels between the dye application location and in another detecting position at which it detects a color characteristic of the web after the web has exited the further treatment location. The controlling means is operatively connected to the device for selectively removing moisture from the web and the color characteristic detecting means for controlling the device for selectively removing moisture from the web in response to detection of the web by the color characteristic detecting means in both its initial detecting position and its another detecting position.

According to preferred features of the another aspect of the present invention, the apparatus also includes first means for guiding the web in a first generally linear path during the passage of the web past the color characteristic detecting means at its initial detecting position for detection of the web and second means for guiding the web after exiting the drying location in a second generally linear path during passage of the web past the color characteristic detecting means in its another detecting position. The first generally linear path and the second generally linear path are substantially parallel to one another at a spacing from one another dimensioned such that the initial detecting position and the another detecting position of the color characteristic detecting means are both disposed intermediate the first and second generally linear paths.

Preferably, the color characteristic detecting means includes a single detecting device movable between the initial detecting position and the another detecting position. Also, the means for moving the color characteristic detecting means preferably includes means for pivoting the detecting device about a pivot axis extending generally parallel to the first and second generally linear paths.

BRIEF DESCRIPTION OF THE DRAWINGS

The sole FIGURE of the drawings is a schematic front elevational view of the preferred embodiment of the dye application monitoring application of the present invention.

DESCRIPTION OF THE PREFERRED EMBODIMENT

As seen in the sole FIGURE of the drawings, the preferred embodiment of the dye application monitoring apparatus which implements the method of the present invention is illustrated. The dye application monitoring apparatus monitors the application of dye to a web of textile material 1 which may comprise, for example, woven, knit, or non-woven textile material. The web 1 is traveled along a treatment path and, during its travel, dye is applied to the web, excess moisture removed from the dye treated web and then the web is traveled through a drying apparatus. Following this travel sequence, more particularly, as seen in the sole FIGURE of the drawings, the textile web 1 travels in trained relation around an entry guide roller 2 just prior to travel of the web in submerged manner in a dye liquor bath 5 which is filled with a dye liquor 5 which is filled with a dye liquor 4. A bath guide roller 3 is rotatably supported in the dye liquor bath 5 below the level of the dye liquor 4 and this arrangement ensures that each portion of the web 1 is completely submerged in the dye liquor 4 as it travels in trained relation around the bath guide roller 3 in the dye liquor bath 5. After exiting the dye liquor bath 5, the web 1, which is now a dye treated web, travels through a nip roller assembly 6 comprising a pair of nip rollers 7,8 for applying adjustable lateral compressive pressure to the web 1 as the web travels through the nip formed by the two rollers. A nip adjustment device 9 is operatively connected to the nip roller 7 for adjustably increasing or decreasing the nip pressure applied by the nip roller 7,8 by moving the nip roller 7 laterally toward or away from the nip roller 8.

Following its emergence from the nip roller assembly 6, the dye treated web 1 travels along a portion of its travel path which will be referred to as an initial adjusted moisture path portion 17 and the condition of the web 1 as it travels in this path portion is that the web is still moist from its dye treatment in the dye liquor bath 5, yet the moisture content of the web 1 as it emerged from the dye liquor bath 5 has been initially adjusted by the action of the nip roller assembly 6 (i.e., the nip roller assembly 6 has removed some of the dye—and, therefore, the moisture content—of the web 1).

As the web travels through the initial moisture adjusted path portion 17 in the travel direction indicated by the arrow 18, it travels past a device for performing an initial monitoring of a color characteristic of the web 1 in the form of a detecting assembly 10. The detecting assembly 10 is connected via a connector 22 to a control unit 23, which is itself connected to the nip adjustment device 9 via a connector 25. The detecting assembly 10, the control unit 23, and the nip adjustment device 9 thus comprise a feedback control loop for adjustably controlling the moisture content of the web in response to an initial detected color characteristic of the web and other detected characteristics, as will be described in more detail below.

Following its passage past the detecting assembly 10, the dye treated web 1 travels past a moisture detecting apparatus 11 which is operatively connected by a connector 24 to the control unit 23. The control unit 23 controls the nip adjustment device 9 in response to the detected moisture content detected by the moisture detecting apparatus 11 in conjunction with information concerning the color characteristic of the web 1 as provided by the color characteristic assembly 10, as will be described in more detail below.

Following further the travel path of the dye treated web 1, the web travels in trained relation around an entry drying guide roller 12 after the web has passed the moisture detecting apparatus 11. As it travels beyond the entry drying device guide roller 12, the dye treated web enters a drying device 13 which may be configured as any one of several conventional web drying devices such as, for example, a thermosol-type device, for drying of the dye treated web to a predetermined degree. During its travel through the drying device 15, the dye treated web 1 may travel in trained relation around a plurality of guide rollers before existing the drying device 13 and traveling in trained relation around an exit guide roller 14.

Upon its exit from the drying device 13, the dye treated web 1 has been dried to a predetermined degree and this drying action typically influences the color characteristic of the web. The dye treated web 1 now travels in trained relation around a pair of rollers 15 disposed in spaced relation to one another at positions selected in correspondence with the initial adjusted moisture path portion 17 in this manner: the rollers 14 are disposed such that the dye treated web 1 travels along a post drying path portion 16 extending parallel to, and generally coextensive with, the initial adjusted moisture path portion 17 and spaced therefrom by a spacing A selected in correspondence with the position of the color characteristic detecting assembly 10. Thus, the initial one of the pair of the rollers 15 over which the web 1 travels may be positioned laterally intermediate the exit roller 14 and the initial adjusted moisture path portion 17 or may be positioned laterally outwardly of the exit roller 14, depending upon the position of the color characteristic detecting assembly 10 as determined in accordance with the dimensional requirement that the color characteristic detecting assembly 10 be spaced from the web 1 by the same detection distance a when it is detecting the color characteristic of the web as it travels in the initial moisture adjusted path portion 17 as it is spaced from the web 1 as the web travels through the post drying path portion 16.

The color characteristic detecting assembly 10 may comprise two separate detecting devices each operable to detect a color characteristic of the web 1 at a single position thereof along its travel path. However, the color characteristic detecting assembly 10 preferably comprises a detector head 21 pivotally mounted on a base portion for pivoting through a range of 180° about a pivot axis 20. The detector head 21 is pivotable from an initial detecting position, shown by the broken lines in the sole FIGURE of the drawings, for detecting a color characteristic of the web relatively shortly after a dye application to a post drying detecting location, as indicated by the solid lines in the sole FIGURE of the drawings, for detecting a color characteristic of the dye treated web 1 following its passage through a drying device, as will be explained in more detailed below.

The pivot axis 20 of the color characteristic detecting assembly 10 extends parallel to the initial moisture adjusted path portion 17 and the post drying path portion 16. The detector head 21 pivots in a plane parallel to a transverse axis 19 extending perpendicular to the pivot axis 20 and the path portions 16,17.

The extent of the spacing A between the initial adjusted moisture path portion 17 and the post drying path portion 16 is selected in correspondence with the operating requirements of the detector head 21—i.e., in correspondence with the spacing requirements of the detector head 21 from the respective path portion for proper detecting of the web 1 traveling therethrough. In the preferred embodiment of the dye application monitoring apparatus shown in the sole FIGURES of the drawings, the pivot axis 20 bisects the spacing A due to the relationship that the detection distance a between the detector head 21 and the path portion 16 is the same as the detection distance a between the detector head 21 and the path position 17.

The operation of the dye application monitoring apparatus in implementing the method of the present invention is as follows. The web 1 is traveled initially through the dye liquor bath 5 and the now wet dye treated web thereafter travels through the nip formed by the pair of the nip rollers 7,8, which operate to squeeze excess dye from the web. As the web 1 travels further along the initial adjusted moisture path portion 17, the detector head 21, which is in the broken line position shown in the sole figure of the drawings, detects a color characteristic of the web 1 and transmits this information by the connector 22 to the control unit 23. After traveling through the initial detecting location at which the detector head 21 detects a color characteristic of the web, the dye treated web 1 travels past the moisture detecting apparatus 11 which detects a characteristic of the moisture content of the web 1 and transmits this information via the connector 24 to the control unit 23. Following its travel past the moisture detecting apparatus 11, the dye treated web 1 travels around the entry roller 12 and thereafter into the drying apparatus 13 for drying of the web. As the web 1 exits the drying device 13, it travels in trained relation around the exit roller 14 and shortly thereafter around the pair of rollers 15. As the web 1 travels between the pair of the rollers 15 in the post drying path portion 16, the detector head 21 detects a color characteristic of the web and reports this information via the connector 22 to the control unit 23.

The control unit 23 evaluates the information received from the color characteristic detector assembly 10 relating to the initial detection by the detector head 21 and the information received from the moisture detecting apparatus 11 to determine optimum operational parameters of the nip roller assembly 6. However, the control unit 23 also receives additional information from the color characteristic detecting assembly 10 which allows the control unit to more accurately control the operational parameters of the nip roller assembly 6.

The additional information received from the color characteristic detecting assembly 10 is information provided by the detector head 21 due to its detection of the web 1 as the web travels through the post drying path portion 16 following drying of the web in the drying device 13. The color characteristic detected during each of the initial detecting and the post-drying detecting steps can be, for example, the intensity of color. To perform this additional detecting, the detector head 21 is pivoted between its two detecting positions according to any suitable schedule or arrangement. For example, the detector head 21 can be pivoted between its two detecting positions in correspondence with the travel of the web 1 such that the detector head 21 detects generally the same portion of the web 1 both during the passage of the respective portion of the web through the initial moisture adjusted path portion 17 and during the passage of the same web portion through the post drying path portion 16. Alternatively, the detector head 21 can be pivoted between its two detecting positions in a cyclic manner at uniform time intervals or in a random manner. The selection of the schedule or arrangement for pivoting the detector head 21 between its two detecting positions is a matter of optimizing the dye application monitoring process; the advantages of the monitoring method of the present invention accrue no matter what the schedule or arrangement due to the fact that the detecting means for both the initial detection of the dye treated web 1 and for the post drying detection of the web is the same—e.g., the color characteristic detecting assembly 10. Thus, the detecting results are not influenced or skewed by factors such as aging or degrading of the operation of the color characteristic detecting assembly 10 since the influence of aging or degrading of the operation of the color characteristic detecting assembly equally influences both the initial detecting step and the post drying detecting step. Also, environmental factors such as the presence of airborne debris are automatically compensated for since these environmental factors will equally affect both the initial detecting results and the post drying detecting results.

The control unit 23 controls the operation of the nip adjustment device 9 in response to the control unit's evaluation of the information received from the moisture detecting apparatus 11 as well as information received from the color characteristic detecting assembly 10 regarding both its initial detection of the web 1 and its subsequent detection of the web after the web has traveled through the drying device 13. The control unit 23 can be configured to evaluate information from both detecting steps conducted by the color characteristic detecting assembly 10 to determine the difference, if any, between the detected values, as well as the magnitude of the difference. Furthermore, the control unit 23 can be configured to respond to the magnitude or type of differences between the detected values provided during the two color characteristic detecting steps and to control the operation of the nip adjustment device 9 accordingly. For example, a difference in the detected values provided by both color characteristic detecting steps may arise if a color characteristic of the web 1 has changed during its travel between the two detecting locations. Such a situation may occur, for example, if a change in the color characteristic of the web arises during the drying process, which necessarily means that such a change cannot be detected until after the web has been subjected to the drying process. While it may be expected and even desirable that there be a difference in the color characteristics of the web before and after drying thereof, the color characteristic of the web after drying may be unacceptable. For example, while it may be anticipated that the color intensity may be somewhat reduced after drying as compared to the color intensity shortly after nip treatment (and before drying), the color intensity may be detected in the post drying step as too diminished.

In addition, or alternatively, the control unit 23 may be configured to respond to a difference in the detected values provided during the two color characteristic detecting steps which indicates that the rate of color setting or fixing may not be within acceptable limits. In all these situations, the control unit 23 can adjustably control the operational parameters of the nip adjustment device 9 to change or prevent the occurrence of similar color conditions in following portions of the web 1 which have not yet traveled through the nip roller assembly 6.

Although not described in detail, it is also contemplated that the control unit 23 can be configured with a so-called self-learning capability to automatically adjust its control of the nip adjustment device 9 based upon receipt of information from, among other sources, the two color characteristic detecting steps, without the need for intervention by an operator to re-adjust the control unit to provide a different set of control instructions to the nip adjustment device 9. With such a self-learning capability, the control unit 23 can monitor trends such as the repeated occurrence of a change in the color characteristic of the web 1 as evidenced by a difference in the detecting information provided in the post-drying detecting drying steps as compared to the initial detecting step and can correspondingly control or regulate its control of the nip adjustment device 9 to increase or decrease its compressive action on the web 1 to thereby to favorably influence the color characteristic of the web.

Although the method of the present invention has been described as including a post-drying detecting step during which the dye treated web is additionally detected shortly after its passage through a drying device, the present invention is to be understood as encompassing the broader concept of detecting the dye treated web at any selected second or subsequent location at a selected time after an initial detecting step to thereby obtain information concerning the color characteristic of the web. Such information may be derived from an analysis of the difference between the detected value or values obtained during the initial detecting step as compared to the detected value or values obtained during the second or subsequent detecting step. Additionally, such information may be obtained due to the fact that the second or subsequent detecting step is performed after a predetermined period of time has lapsed since the dye has been applied to the web or due to the fact that the second or subsequent step is performed after handling of the web in a certain post-dye application step such as, for example, a drying process step as described with respect to the preferred embodiment herein. While the second or subsequent detecting step has been described with respect to the preferred embodiment of the method and apparatus as taking place following the passage of the web through a drying device, it is to be understood that the scope of the present invention is not limited to only those situations in which the location along the web's travel path at which the second or subsequent detecting step occurs is selected based on the factor that it lies after a certain process step. Instead, the location at which the second or subsequent detecting step is conducted may be selected in consideration of the passage of time after certain changes or aspects in the color characteristics of the web has occurred and which may only be detectable after a predetermined of time has passed since a selected event such as, for example, the application of dye to the web or only after the web has been subjected to a certain combination of handling steps.

The present invention further contemplates that the method thereof is capable of broad application to a wide range of textile web types. For example, it is believed that the method of the present invention is particularly advantageous for monitoring the application of dye to a single color textile web, as it is especially important with textile webs of this type to eliminate or minimize any difference in the color characteristic of the central portion of the textile web as compared to the edge portions of the textile web. In such application, the dye application monitoring apparatus of the present invention may be configured to specifically monitor such differences in the color characteristics of a single color textile web in that the color characteristic of the edge portions of the textile web can be compared to the color characteristics of the central portion of the web. For example, the dye application monitoring apparatus can be configured to monitor a color characteristic of the edge portions of the web during the initial detecting step and to subsequently detect a color characteristic of the central portion of the web during the post-drying detecting step. Since the detecting steps are performed by the same detecting apparatus 10, there is no need to take into account and compensate for the non-web difference in the two detected values such as, for example, differences in the conditions of two detectors in the event two detectors were used.

It will therefore be readily understood by those persons skilled in the art that the present invention is susceptible of broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

We claim:

1. Apparatus for controlling a dye treatment process in which a web of textile material is sequentially traveled through a dye application location at which dye is applied to the web, a moisture reduction location at which dye is removed from the web by a device for selectively removing moisture, and a drying location at which the dye treated web is subjected to a further treatment, comprising:

means for detecting a color characteristic of the web, the color characteristic detecting means being operable in an initial detecting position in which it detects a color characteristic of the web as the web travels between the dye application location and the further treatment location, and in another detecting position at which it detects a color characteristic of the web after the web has exited the further treatment location; and means, operatively connected to the device for selectively removing moisture from the web and the color characteristic detecting means, for controlling the device for selectively removing moisture from the web in response to detection of the web by the color characteristic detecting means in both its initial detecting position and its another detecting position.

2. Apparatus according to claim 1 and further comprising first means for guiding the web in a first generally linear path during the passage of the web past the color characteristic detecting means at its initial detecting position for detection of the web and second means for guiding the web after exiting the drying location in a second generally linear path during passage of the web past the color characteristic detecting means in its another detecting position, the first generally linear path, and the second generally linear path being substantially parallel to one another at a spacing from one another dimensioned such that the initial detecting position and the another detecting position of the color characteristic detecting means are both disposed intermediate the first and second generally linear paths.

3. Apparatus according to claim 2 wherein the color characteristic detecting means includes a single detecting device movable between the initial detecting position and the another detecting position.

4. Apparatus according to claim 3 wherein the means for moving the color characteristic detecting means includes means for pivoting the detecting device about a pivot axis extending generally parallel to the first and second generally linear paths.

5. Apparatus according to claim 1 wherein the color characteristic detecting means includes a single detecting device movable between the initial detecting position and the another detecting position.

* * * * *